US011478099B1

(12) United States Patent
Bates et al.

(10) Patent No.: US 11,478,099 B1
(45) Date of Patent: Oct. 25, 2022

(54) SMART-HOME ENABLED PACKAGE RECEIPT FURNITURE

(71) Applicant: Midge Inc., New Orleans, LA (US)

(72) Inventors: Elizabeth Sylvia Bates, New Orleans, LA (US); Michael Lee Wong, New Orleans, LA (US); Douglas Hardy Miller, New Orleans, LA (US); Jeremy Bates, Sonoma, CA (US)

(73) Assignee: Midge Inc., New Orleans, LA (US)

( * ) Notice: Subject to any disclaimer, the term of this patent is extended or adjusted under 35 U.S.C. 154(b) by 208 days.

(21) Appl. No.: 16/906,047

(22) Filed: Jun. 19, 2020

Related U.S. Application Data

(60) Provisional application No. 62/863,718, filed on Jun. 19, 2019.

(51) Int. Cl.
*A47G 29/14* (2006.01)
*A47G 29/28* (2006.01)
*A47B 83/00* (2006.01)

(52) U.S. Cl.
CPC ..... *A47G 29/141* (2013.01); *A47B 83/00* (2013.01); *A47G 29/28* (2013.01); *A47G 2029/142* (2013.01); *A47G 2029/145* (2013.01); *A47G 2029/147* (2013.01); *A47G 2029/149* (2013.01)

(58) Field of Classification Search
CPC ..... A47G 29/20; A47G 29/141; A47G 29/28; A47G 29/12095; A47G 2029/142; A47G 2029/145; A47G 2029/147; A47G 2029/149; E06B 7/32; E05G 7/00; A47B 83/00
USPC ..... 232/19, 42, 45, 43.4, 43.5; 109/19, 67, 109/68; 49/68
See application file for complete search history.

(56) References Cited

U.S. PATENT DOCUMENTS 492,443 A * 2/1893 Stewart ..... A47G 29/12 49/67
1,222,964 A * 4/1917 Matchette ..... G07F 9/06 232/1 R
4,024,729 A * 5/1977 Abate, Sr. ..... F25D 23/10 62/263
5,774,053 A 6/1998 Porter
5,921,191 A * 7/1999 Gabel ..... E05G 7/005 109/7
5,979,750 A 11/1999 Kindell
6,079,216 A * 6/2000 de Marsillac Plunkett ..... A47G 29/20 312/286
6,253,711 B1 * 7/2001 Shibles ..... A01K 1/035 119/484
6,415,552 B1 7/2002 Khosropour
(Continued)

*Primary Examiner* — William L Miller
(74) *Attorney, Agent, or Firm* — Rosenthal IP Law; Lawrence Rosenthal

(57) ABSTRACT

The disclosed invention includes a dwelling fixture. The dwelling fixture includes a compartment configured to contain packages delivered to the dwelling, an interior door to access the compartment from the interior of the dwelling, and an exterior door to access the compartment from the exterior of the dwelling. The interior door and/or exterior door includes a locking mechanism to secure the compartment. The dwelling fixture is easily and securely installable through the walls of the dwelling. The exterior door is flush with the exterior of the dwelling and aesthetically integrated with trim that adapts to any exterior finish.

7 Claims, 12 Drawing Sheets

(56) References Cited

U.S. PATENT DOCUMENTS

| | | | | |
|---|---|---|---|---|
| 6,484,531 | B1 * | 11/2002 | Hambleton | F25D 23/10 312/286 |
| 7,815,112 | B2 * | 10/2010 | Volpe | G07F 17/13 340/568.1 |
| 8,160,741 | B1 * | 4/2012 | Shoenfeld | A47B 96/00 221/92 |
| 9,619,955 | B2 | 4/2017 | Eichenblatt | |
| 10,039,401 | B1 | 8/2018 | Romanucci | |
| 10,238,210 | B1 * | 3/2019 | Shoenfeld | A47B 96/00 |
| 10,729,265 | B2 * | 8/2020 | High | F25D 23/10 |
| 10,932,567 | B1 * | 3/2021 | Allen | A47B 83/00 |
| 10,954,068 | B2 * | 3/2021 | Nevison | A47G 29/30 |
| 11,051,613 | B1 * | 7/2021 | Gilbreath | E05B 65/46 |
| 2001/0045449 | A1 * | 11/2001 | Shannon | G07C 9/21 232/19 |
| 2006/0179724 | A1 * | 8/2006 | Lee | E04H 3/02 52/79.1 |
| 2007/0204514 | A1 * | 9/2007 | Grimmett | E06B 7/32 49/169 |
| 2012/0158606 | A1 * | 6/2012 | Moudy | G06Q 10/083 705/332 |
| 2017/0213187 | A1 * | 7/2017 | Choi | G06K 7/10297 |
| 2019/0231106 | A1 * | 8/2019 | Kaiserman | F25D 23/10 |
| 2021/0005033 | A1 * | 1/2021 | Roman | G06Q 10/0833 |
| 2021/0082219 | A1 * | 3/2021 | Kane | E06B 7/32 |
| 2021/0106160 | A1 * | 4/2021 | Janas | A47G 29/30 |
| 2022/0039581 | A1 * | 2/2022 | Lee | F25D 29/008 |

* cited by examiner

SMART-HOME ENABLED PACKAGE RECEIPT FURNITURE

CROSS-REFERENCE TO RELATED APPLICATIONS

This application claims priority to U.S. Provisional Appl. No. 62/863,718 filed on Jun. 19, 2019.

BACKGROUND

Package delivery is the delivery of shipping containers, parcels, or high-value mail as single shipments to consumer residences. The service is provided by most postal systems, express mail, and private courier companies. A Pew Research Center survey conducted in 2015found that 79% of U.S. adults made an online purchase of any type, which is up from 22% in 2000. About 43% of these purchases are made routinely, ranging from a few times per month to weekly. In total, this constitutes 9% of all retail sales in the U.S., according to the Department of Commerce. Online purchases are delivered to consumer homes via package delivery services.

Package theft from consumer residences is a growing issue. According to a survey by XFINITY HOME®, a COMCAST® home security service, 30% of Americans say that they have had a package stolen from their residence. According to in-person surveys, this number is closer to 40% of Americans. In addition to the inconvenience for consumers, e-commerce companies bear the brunt of the financial loss because most will refund and/or replace the goods in stolen packages. In addition, law enforcement has been unsuccessful at mitigating this problem. For example, arrest rates for "porch pirates" are low (e.g., about 7% in Denver).

BRIEF DESCRIPTION OF THE DRAWINGS

Embodiments of the present technology will be described and explained through the use of the accompanying drawings. The same reference numbers in different drawings may identify the same or similar elements.

Figure 1:
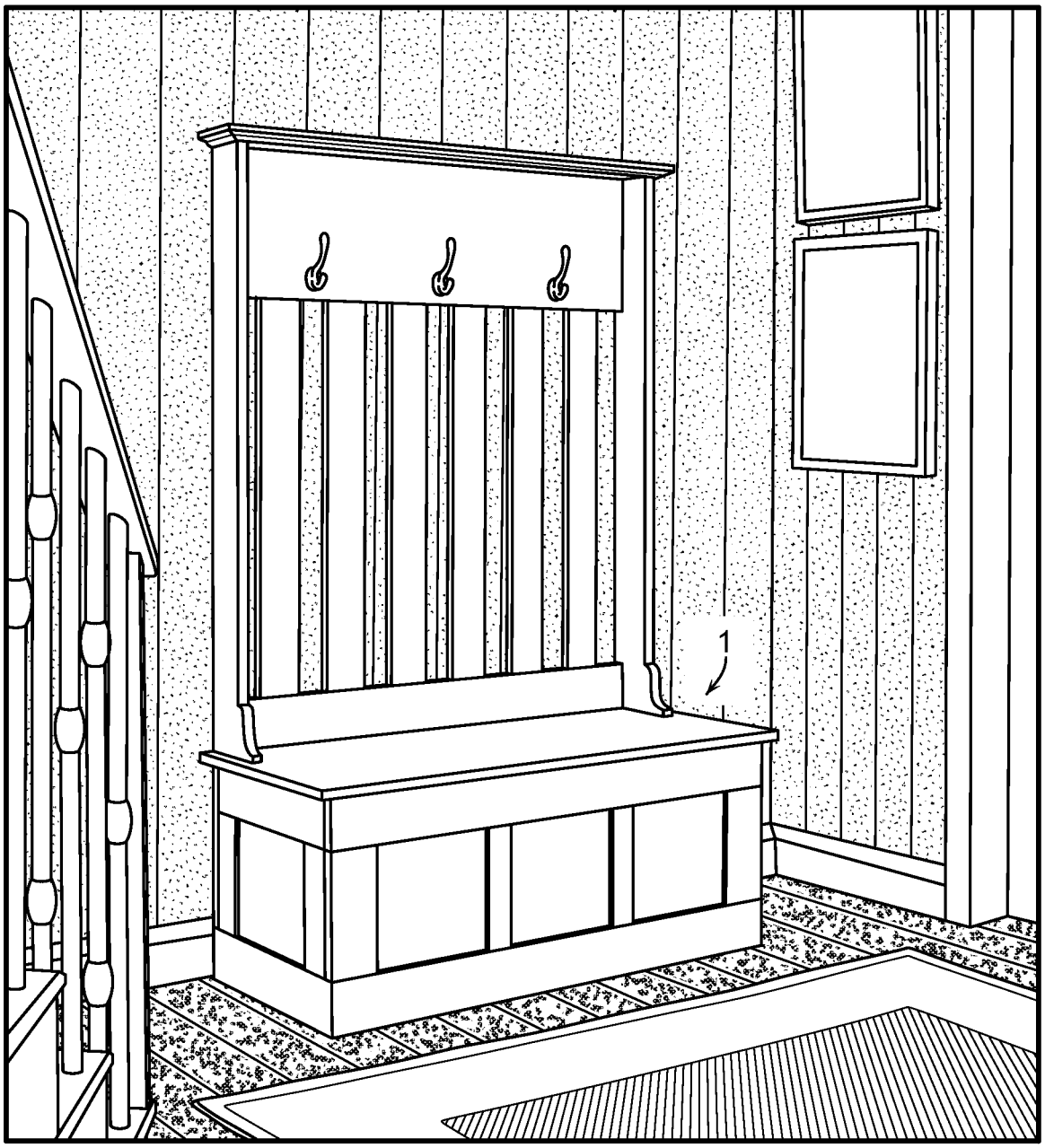
FIG. 1 is an illustration of a furniture unit in an environment of use in the interior of a dwelling.

The drawings, some components and/or operations can be separated into different blocks or combined into a single block when discussing some embodiments of the present technology. Moreover, while the technology is amenable to various modifications and alternative forms, specific embodiments have been shown by way of example in the drawings and are described in detail below. The intention, however, is not to limit the technology to the particular embodiments described herein. On the contrary, the technology is intended to cover all modifications, equivalents, and alternatives falling within the scope of the technology as defined by the appended claims.

DETAILED DESCRIPTION

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. It should be understood that these concepts and applications fall within the scope of the disclosure and the accompanying embodiments.

The purpose of the terminology used herein is only for describing embodiments and is not intended to limit the scope of the disclosure. Where context permits, words using singular or plural form may also include the plural or singular form, respectively.

FIG. 1 is a perspective view of an example of a furniture unit in its environmental use inside of a dwelling. From the interior, the furniture unit is or resembles a hall tree. A hall tree furniture unit is a piece of furniture that is oftentimes next to a front door, with hooks and a storage bench for convenience. People can enter a home and hang their belongings on the hooks and sit on the bench of the hall tree to remove their shoes. A hall tree may have cubby holes to store personal items as well. As such, the furniture unit is designed to resemble this familiar piece of furniture so that people recognize and understand how to use it, although it offers much more functionality than a conventional hall tree. A storage area within a hall tree can serve as a smart and secure package receipt vault by way of its door(s), which open to the exterior and interior of a home or building.

Figure 2:
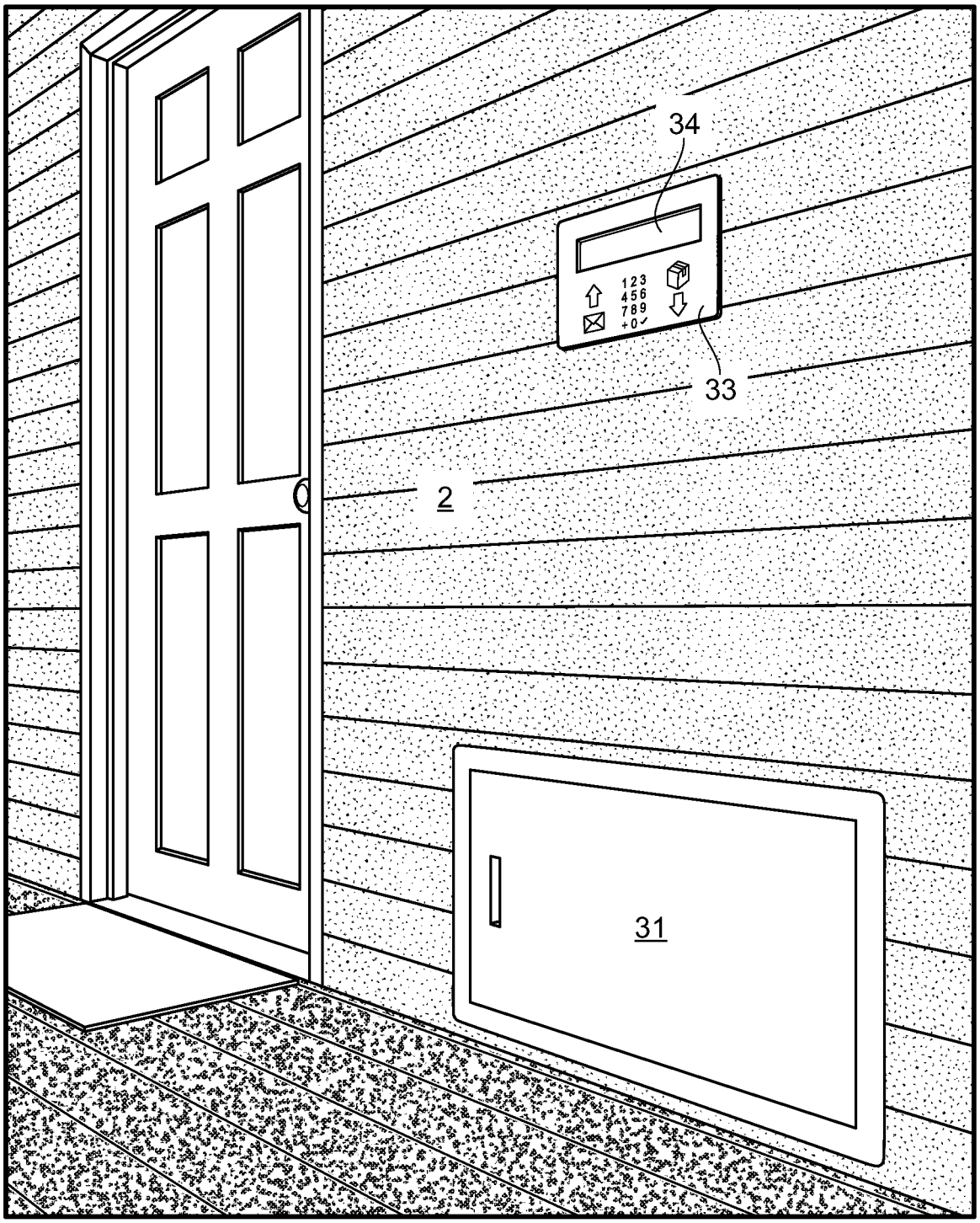
FIG. 2 is an illustration of the furniture unit in an environment of use depicted from the exterior of a building.
Figure 4:
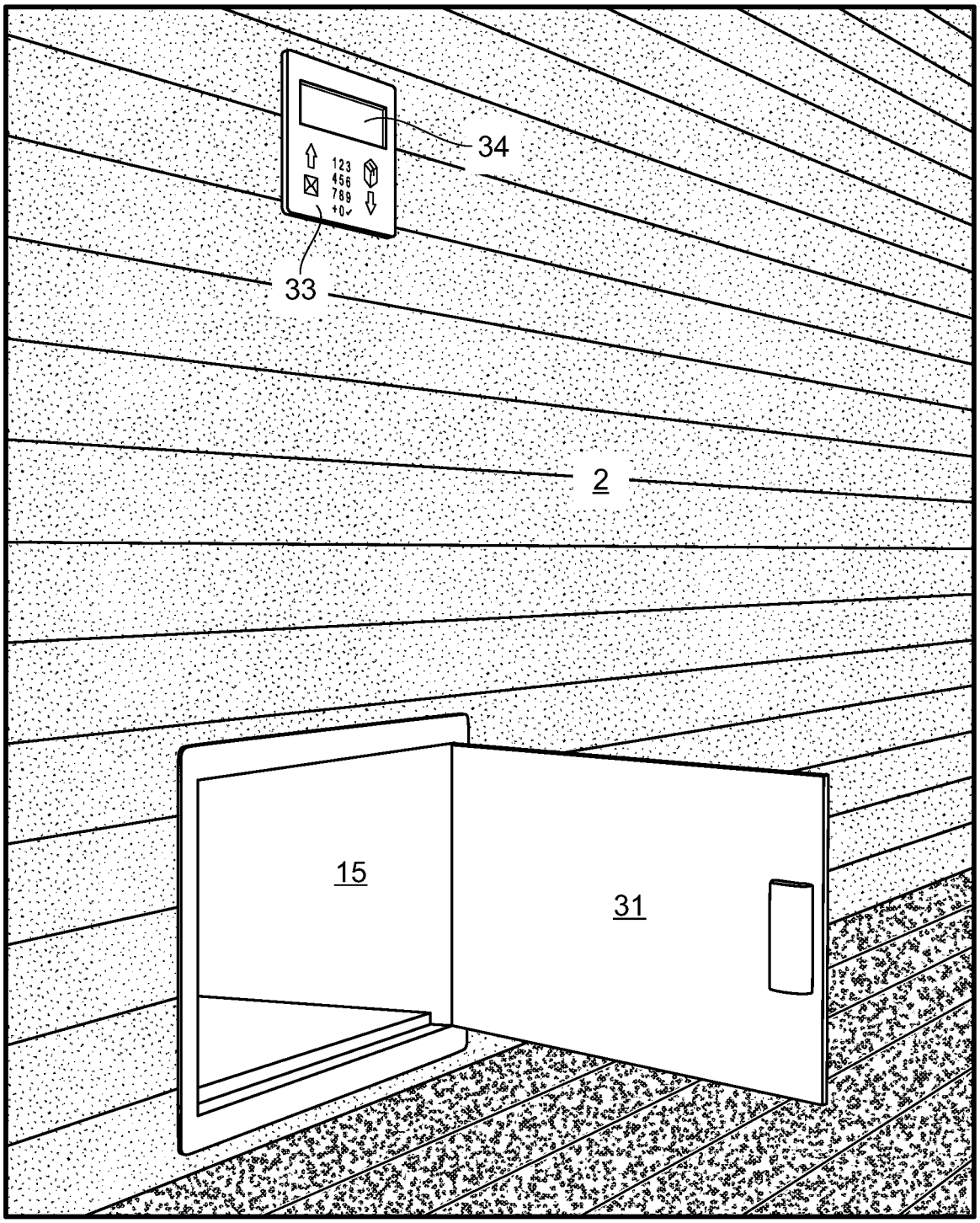
FIG. 4 illustrates a perspective view from the exterior of a building including an interior of the furniture unit.

FIGS. 2 and 4 are left and right perspective views of an example of the furniture unit, in its environmental use on the outside of a dwelling or any building. The furniture unit is embedded into the exterior wall [2] of the building without noticeably protruding or changing the design of the building. The exterior of the furniture unit includes an exterior door [31] essentially flush with the exterior wall [2]. The exterior door [31] may be aesthetically integrated with the exterior wall with trim and hidden hinges. The exterior of the furniture unit also comprises an exterior keypad [33]. When a valid access code is entered into exterior keypad [33], exterior door [31] can be unlocked. An exterior mail slot [34] may provide an entry point for envelopes and small packages. The exterior door [31] may be flush with the exterior wall [2] of a dwelling, reinforced with steel, and secured with hidden piano hinges to provide tamper-proofing. The exterior door may be weather-sealed like a typical entry point (e.g., such as a window or door). The exterior door may be insulated from the exterior, as a proxy for the exterior wall. The exterior door may also be primed so that it can be painted to match the exterior of the home.

Figure 3:
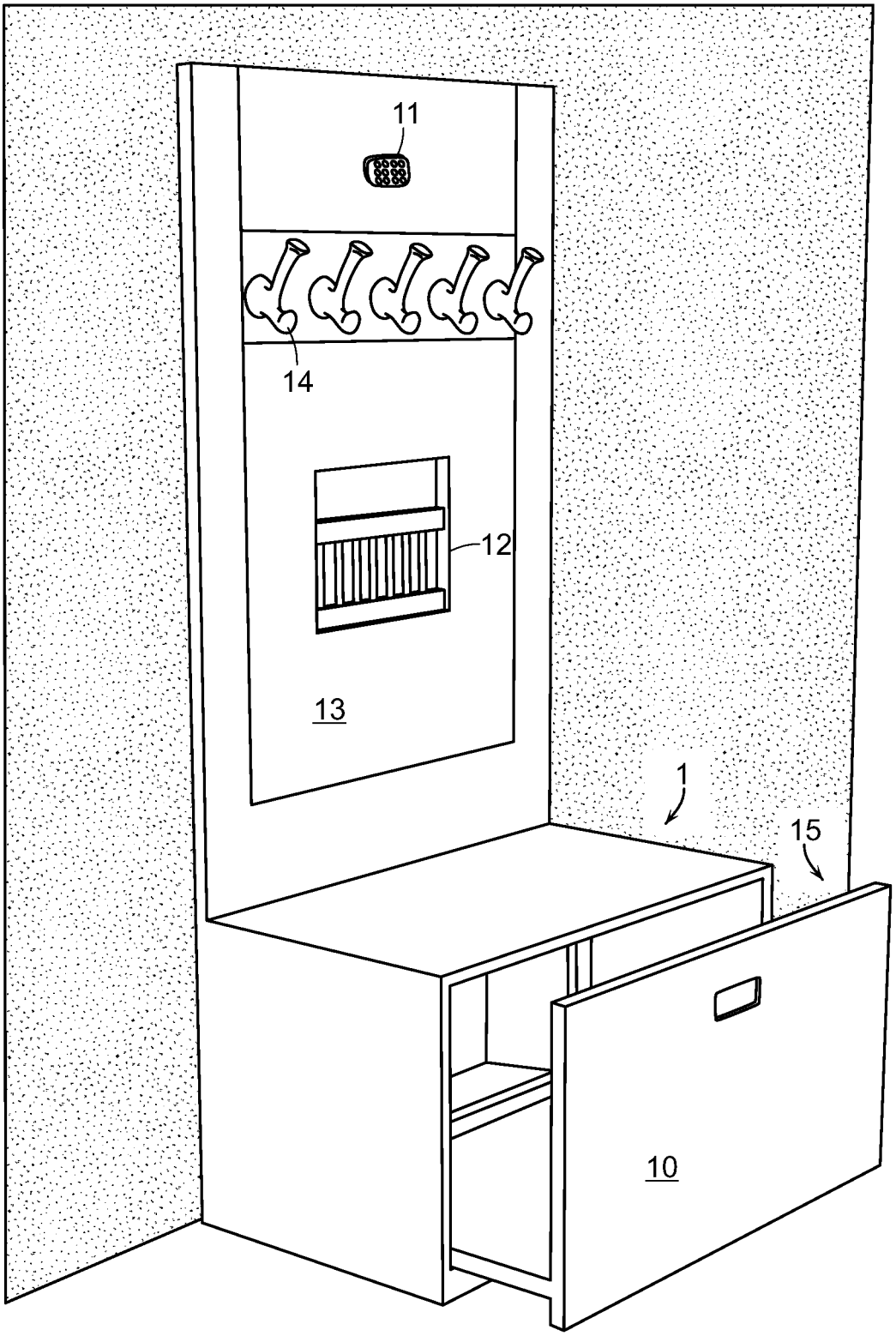
FIG. 3 illustrates a perspective view including an interior of the furniture unit.

FIG. 3 is a perspective view of an example of the furniture unit from the interior of a building. The interior piece [1] of the furniture unit comprises an interior compartment [15]

whereby the furniture unit can securely receive and store packages. The compartment [15] functions as a secure storage area for packages delivered to the building. The compartment [15] is accessible from the exterior and interior of the building, which can be seen in FIG. 4. The furniture unit comprises an interior keypad [11] and an interior door [10] that can be opened by entering a valid access code into the interior keypad [11]. The interior compartment [15] is integrated into the bench of the hall tree furniture unit. As such, the compartment [15] is located mostly inside the dwelling, protruding into the dwelling's interior. The compartment [15] may be steel reinforced to prevent breaking into the furniture unit.

The furniture unit is affixed to the building's wall and is structurally sound to support any hall tree usage, as well as the furniture's usage of the compartment as a secure package storage area. The furniture unit can be made of varying materials on the exterior (e.g., wood with a steel-lined compartment). The interior piece [1] of the furniture unit may have an upper wall [13] flush with the interior wall [25] of the building. The upper wall [13] may be secured to the interior wall [25] of the building as would be an ordinary hall tree, dresser, or the like. The furniture unit may comprise a mail catch [12] recessed into the upper wall [13] and hooks [14] for hanging different items. The mail catch [12] may contain a metal baffle on the exterior to protect the drop opening from fishing, and/or an adjustable chute to accommodate varying wall thicknesses. The mail catch [12] receives envelopes and small packages dropped into exterior mail drop [34].

Figure 5:
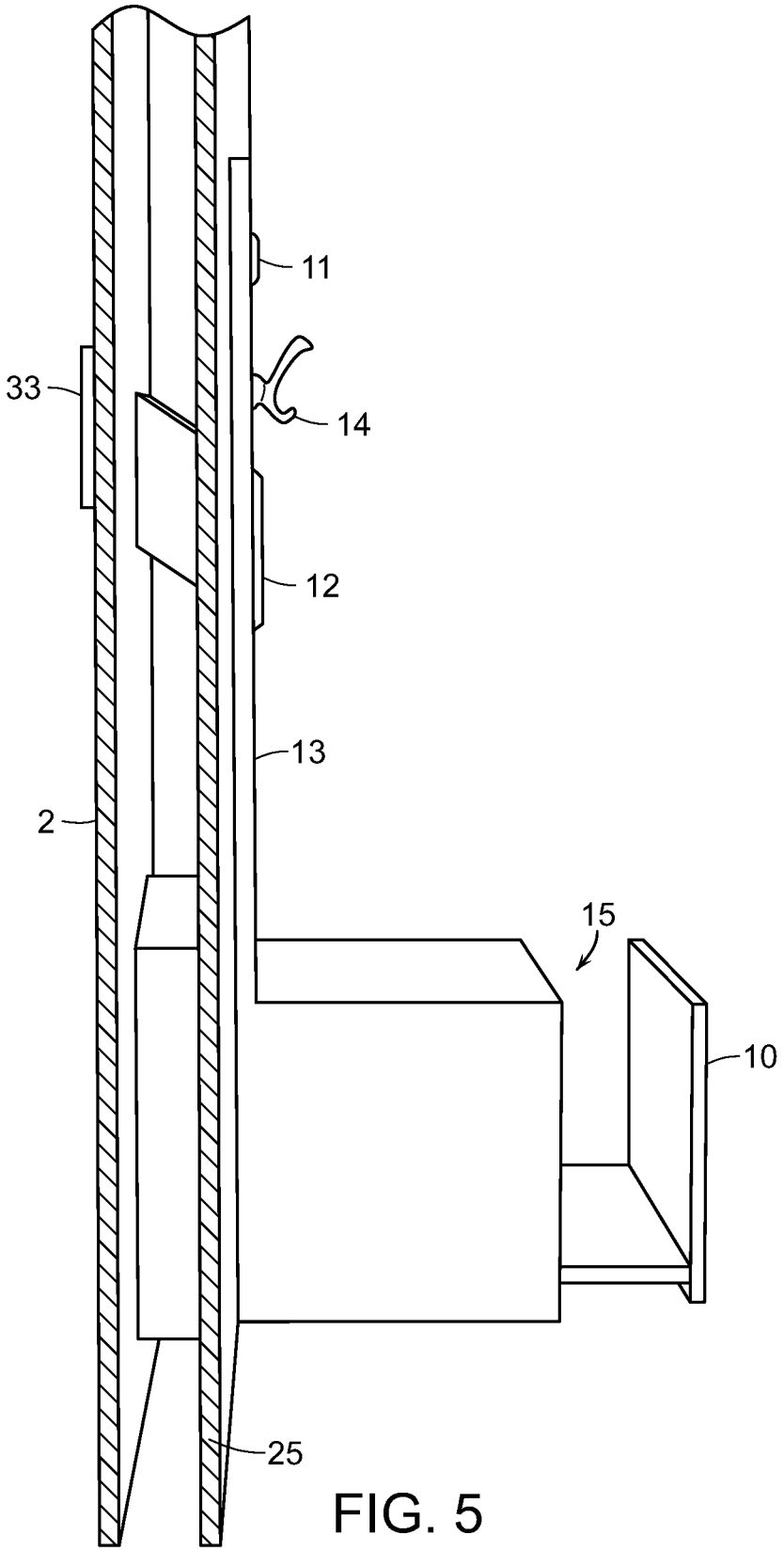
FIG. 5 illustrates a side view of the furniture unit and a wall on which the furniture unit is installed.

FIG. 5 is a side view showing how the furniture unit may be secured through the wall of a building. A building wall is typically comprised of interior wall [25] and exterior wall [2], with vertical studs between the interior and exterior walls. The exterior wall [2] typically further comprises exterior trim, such as brick, plaster, hardy board, and other materials, for aesthetic purposes. The furniture unit may be dimensioned so as to fit between two stud bays of a wall. For example, the furniture unit may have a bench that is 18" high x 30.5" wide x 18" deep. When embodied as a hall tree, the upper wall [13] could have a 64" height.

Figure 6:
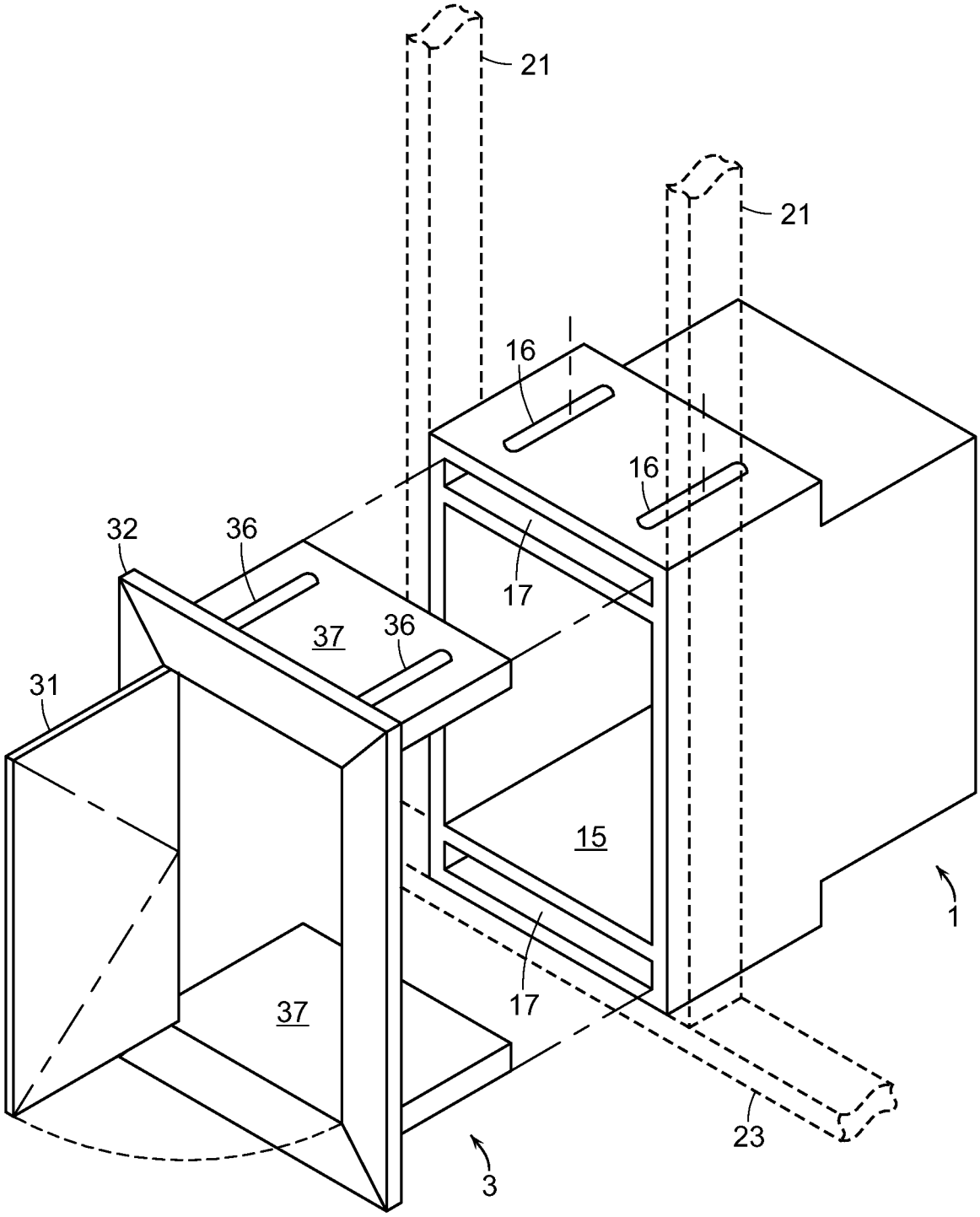
FIG. 6 is a perspective view diagram of an example installation through a wall.

FIG. 6 is a diagram in perspective view showing how the furniture unit is comprised of an interior piece [1] and an exterior piece [3] that are secured together through the interior [25] and exterior [2] walls of the building. The interior piece [1] is secured between vertical studs [21] and secured to the bottom sill [23]. The interior piece [1] comprises upper and lower receivers [17] for receiving corresponding upper and lower connectors [37], and the upper and receivers [17] further comprise adjustable bolting slots [16] whereby the upper and lower connectors [37] can be boltably secured to the interior piece [1], accommodating wall sizes of different thicknesses. The upper and lower connectors [37] are coupled to a face frame [32] for integrating the exterior door [31] with the exterior wall [2] of the building. The face frame [32] is weathertight and insulated. The structure of the furniture unit enables quick installation into the walls of the building. Installation can take thirty minutes or less, in other words, is no more difficult to perform than the installation of a window.

Figure 8:
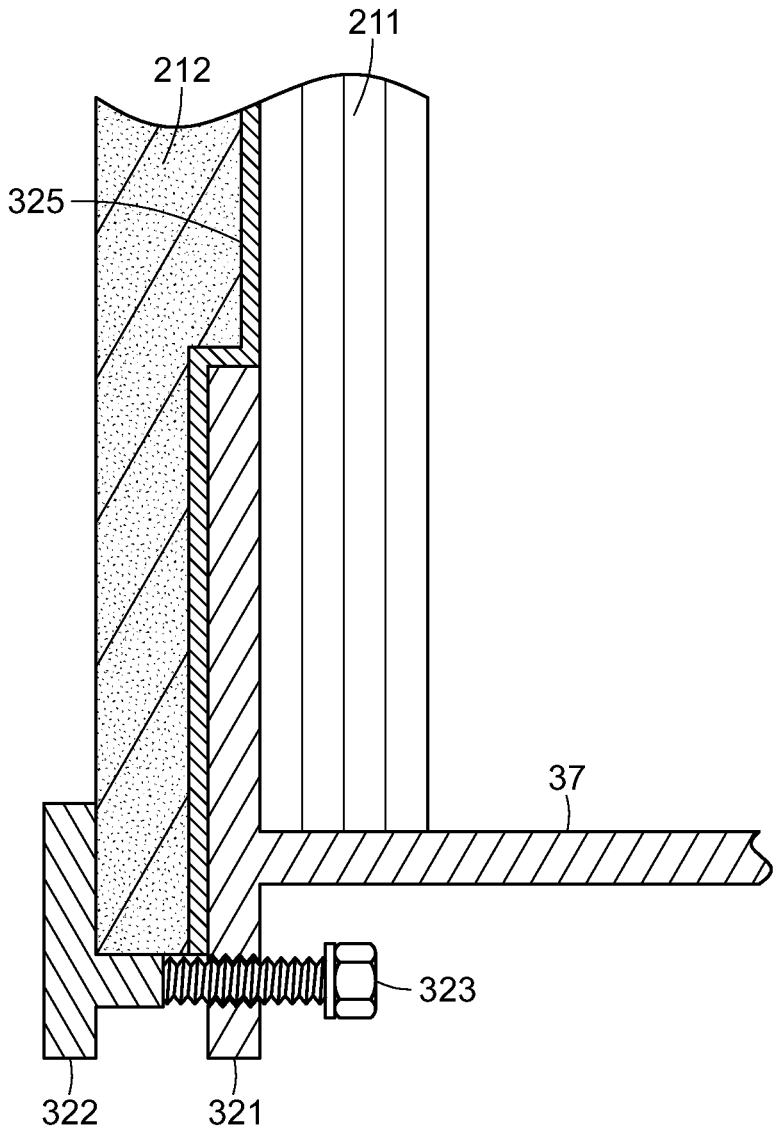
FIG. 8 is cross-sectional detail of an exterior piece of an example furniture unit installed through a wall.
Figure 9:
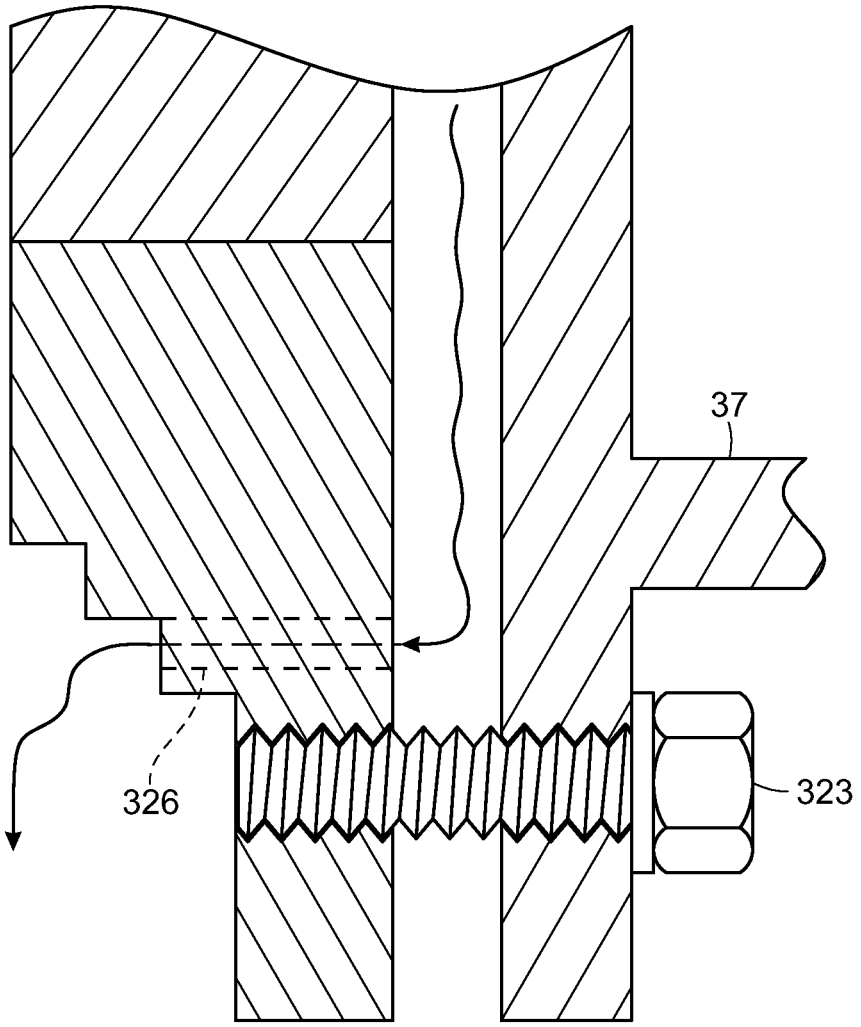
FIG. 9 is a cross-sectional detail of an exterior piece of an example furniture unit installed through a wall.

FIG. 8 is a cross-sectional detail of an exterior piece [3] of the furniture unit installed through the exterior wall [2] of the building. The exterior wall of the building typically comprises an exterior wall [211] that covers the building studs [21], often constructed of plywood or gypsum, and an exterior finish [212] that covers the building for aesthetic purposes. Various exterior finishes include brick, plaster, hardy board, and other materials, all of which can have different thickness. Face frame [32], which is used to secures the exterior door [31] to the interior compartment [15] as described above, comprises face plate [321] coupled to the upper and lower connectors [37], and trim [322] securable to the face plate [321] over the exterior finish [212] using adjustment bolt [323]. Face plate [321] is secured to the exterior wall [211], such as plywood or gypsum walls that typically cover building studs [21]. Adjustment bolt [323] may be secured to trim [322] at a small lip that at least partially covers the adjustment bolt [322], when very thick exterior finishes [212] are involved. Thus, face frame [32] may accommodate different exterior finishes such as plaster, hardy board, brick, etc . . . , which have varying degrees of thickness. Using this structure, the exterior door [31] is flush with the exterior wall [2] and weatherproof. Furthermore, the exterior piece [3] is readily adaptable to different exterior finishes without needing to provide different sizes. Face frame [32] may be covered by waterproofing [325]. As shown in FIG. 9, trim [322] may further comprise invisible weep holes [326] which move moisture or water out and away from the side of the building.

Figure 7:
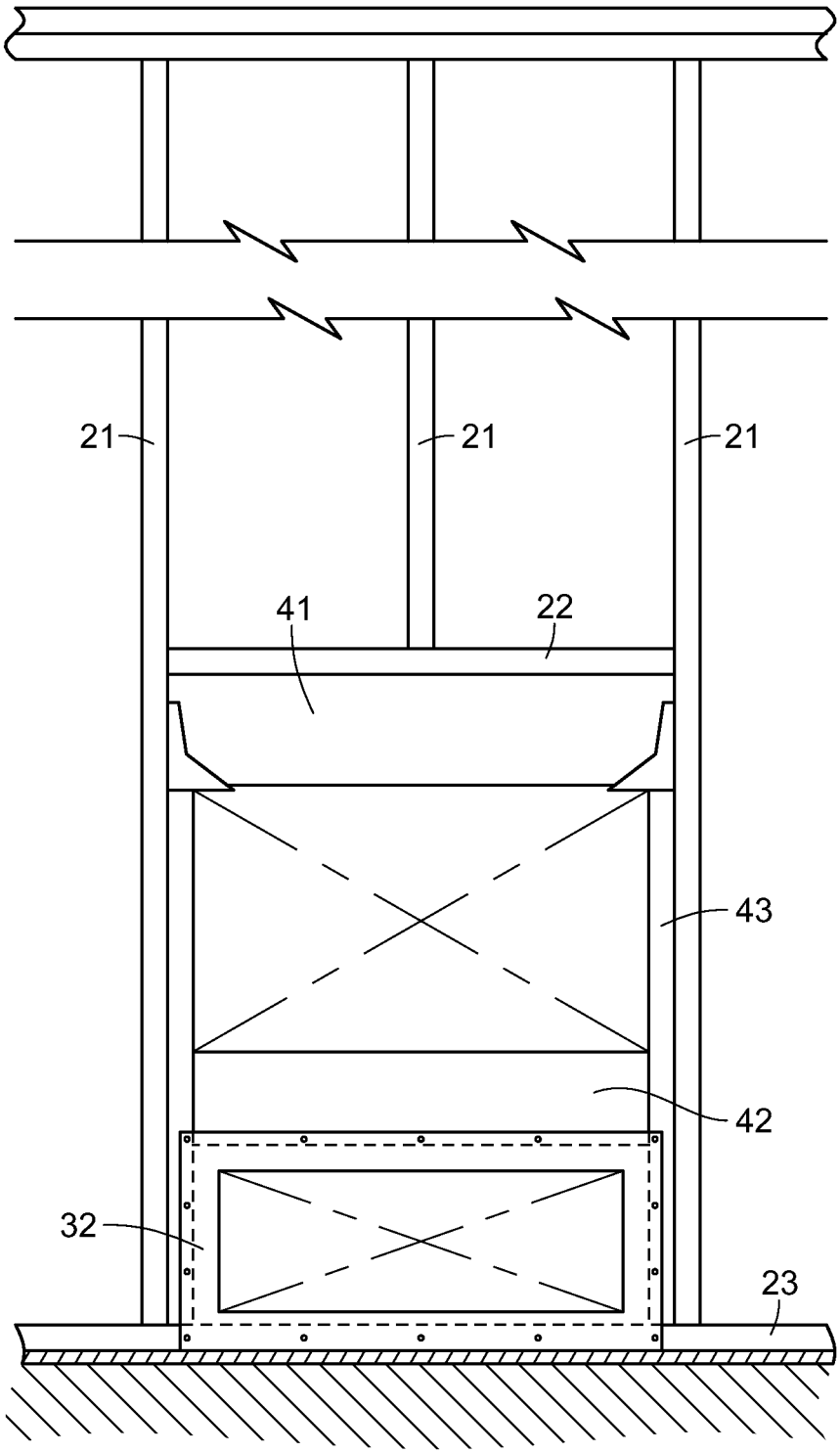
FIG. 7 is a plan view diagram of an example installation through a wall.

FIG. 7 is a plan diagram of an example of the furniture unit's attachment to and integration with building studs [21]. The furniture unit may span two or more studs wherein a portion of the center stud is removed to accommodate the furniture unit. The furniture unit may comprise one or more cross-bracing elements interposed between studs [21], such as header [41] and/or blocker [42], which may be secured to blocking studs [43]. The bottom of the furniture unit may be secured to the sill plate [23]. Using these principles, the furniture unit may be securely installed between one, two or three stud bays for different sized hall trees and package types.

Figure 10:
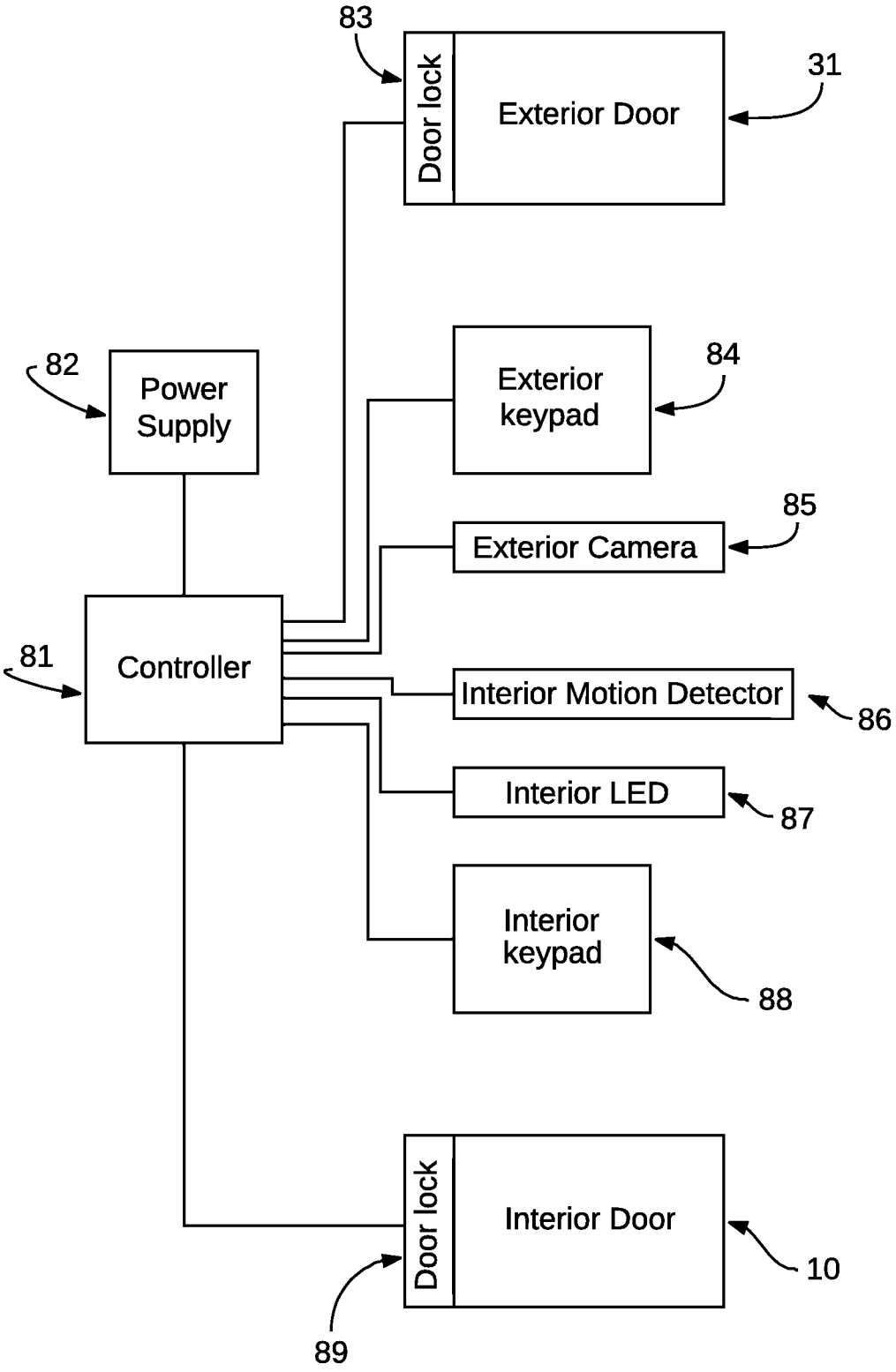
FIG. 10 is block diagram showing an example electronic system integrated with the furniture unit.

FIG. 10 is a block diagram showing an example electronic system integrated with the furniture unit to facilitate package delivery. Controller [81] is operably coupled to an exterior door lock mechanism [83], such as a solenoid door lock, that operates to lock and unlock the exterior door [31], an exterior keypad [84] for receiving access codes, an interior door lock mechanism [89] that operates to lock and unlock the interior door [10], and an interior keypad for receiving access codes. The system may also comprise an exterior camera [84], interior motion detector [86] and/or interior LED [87] operably coupled to the controller. Some embodiments may include additional actuating elements such as a movable drawer within the interior compartment [15]. The exterior and interior keypads [84] and [88], and/or exterior camera [85], can be located anywhere on the furniture unit or on the interior or exterior walls of the building. Controller [81] may be any conventional programmable microprocessor device and may be located anywhere on or in the furniture unit. Controller [81] is operably coupled to a power supply [82], and power may be received from any source such as battery or wall outlet. For instance, the furniture unit may be wired into the home for power with battery backup.

The controller [81] is operable to activate switches operatively coupled to the interior and exterior door locks [83] and [89], respectively, in order to lock and unlock the doors. The switch may be any electronic switch such as a relay, operably coupled to an actuator that operates the door lock. In some embodiments, the embedded package vault is operable to only allow one of two doors (interior or exterior) to open at any point in time. This prevents access into a home from the exterior of the home. The furniture unit can include additional safety and security features, such as a plunger-style manual emergency release from the interior to the exterior of a dwelling, warning labels on the inside of each door, and ventilation components on the storage bench of the hall tree furniture unit. Each door can automatically lock upon closing. Some embodiments may provide the option to manually operate either or both locks. When either door is opened, a limit switch can trigger a light to turn on inside the compartment of the vault.

The interior door [10] of the furniture unit may include a hidden side-hinge door on the front face of the storage bench. The interior door may have a security lock and, for example, the interior keypad [88] and pull-open mechanism on the outside for a homeowner to key in their personal or home's passcode, to open the door. The interior door may also include a motion sensor [86] in the keypad that will cause LED lights to illuminate different colors when someone approaches the keypad. The LED lights can visually indicate whether there is a package contained inside the compartment of the vault (e.g., green if yes, red for no, blue if the package is being chilled).

Figure 11:
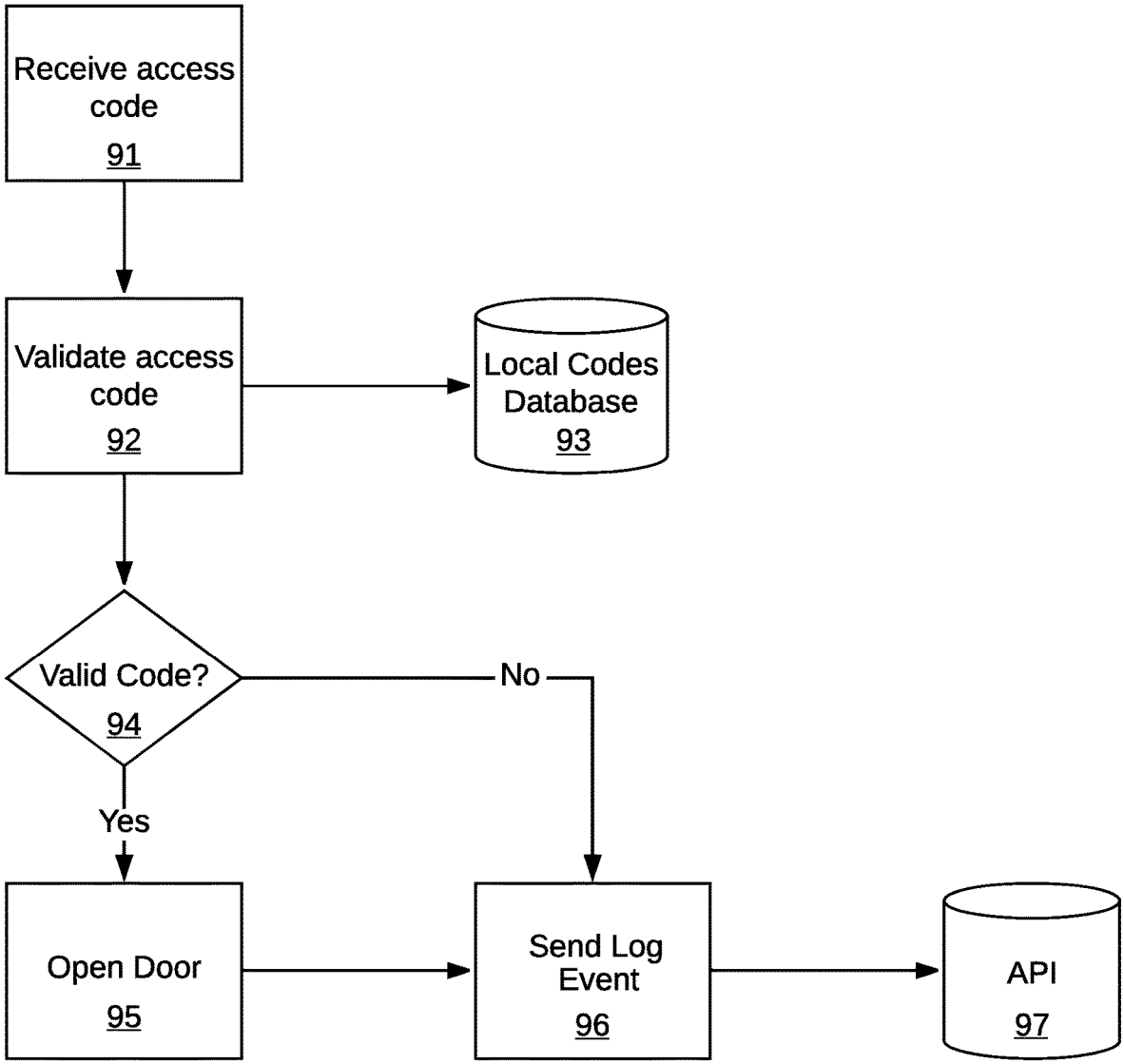
FIG. 11 is a flow diagram illustrating an exemplary method to operate the furniture unit.

FIG. 11 is a process flow diagram for example steps the controller can be programmed to perform. The controller [81] is operable to receive [91] an access code from the interior and exterior keypads [84] and [88], and in response to a valid access code, activate the interior or exterior door locks, respectively. Upon receiving [91] an access code from interior or exterior keypads [84] or [88], controller [81] validates [92] the access code by matching the access code against a local codes database [93]. If the code is validated [94] controller [81] sends a signal to the corresponding interior or exterior door lock [83] or [89] to open [95]. Regardless of whether the open [95] signal is sent, controller may also send [96] a log event to a remote API [97] for further processing. Controller [81] may also be programmed to have a backup key.

A remote API [97] may be used to provide for external control of controller [81] via a wired or wireless communications link. For instance, an external application can be used to update access codes or to access the exterior camera [85]. For example, the furniture unit can connect to a home's WIFI network and can join a smart-home integration platform such as NEST or RING to use a video doorbell's camera capabilities. The furniture unit may access a smart-home integration mobile application. The mobile application can alert homeowners when a package has been delivered, from which seller, and provide a picture of the package being delivered. Either door (exterior or interior) of the embedded package vault may be unlocked from the app. For example, if a neighbor wants to return a pair of shoes that they borrowed, the homeowner may unlock the door remotely instead of needing to give the neighbor a passcode to unlock the door.

Figure 12:
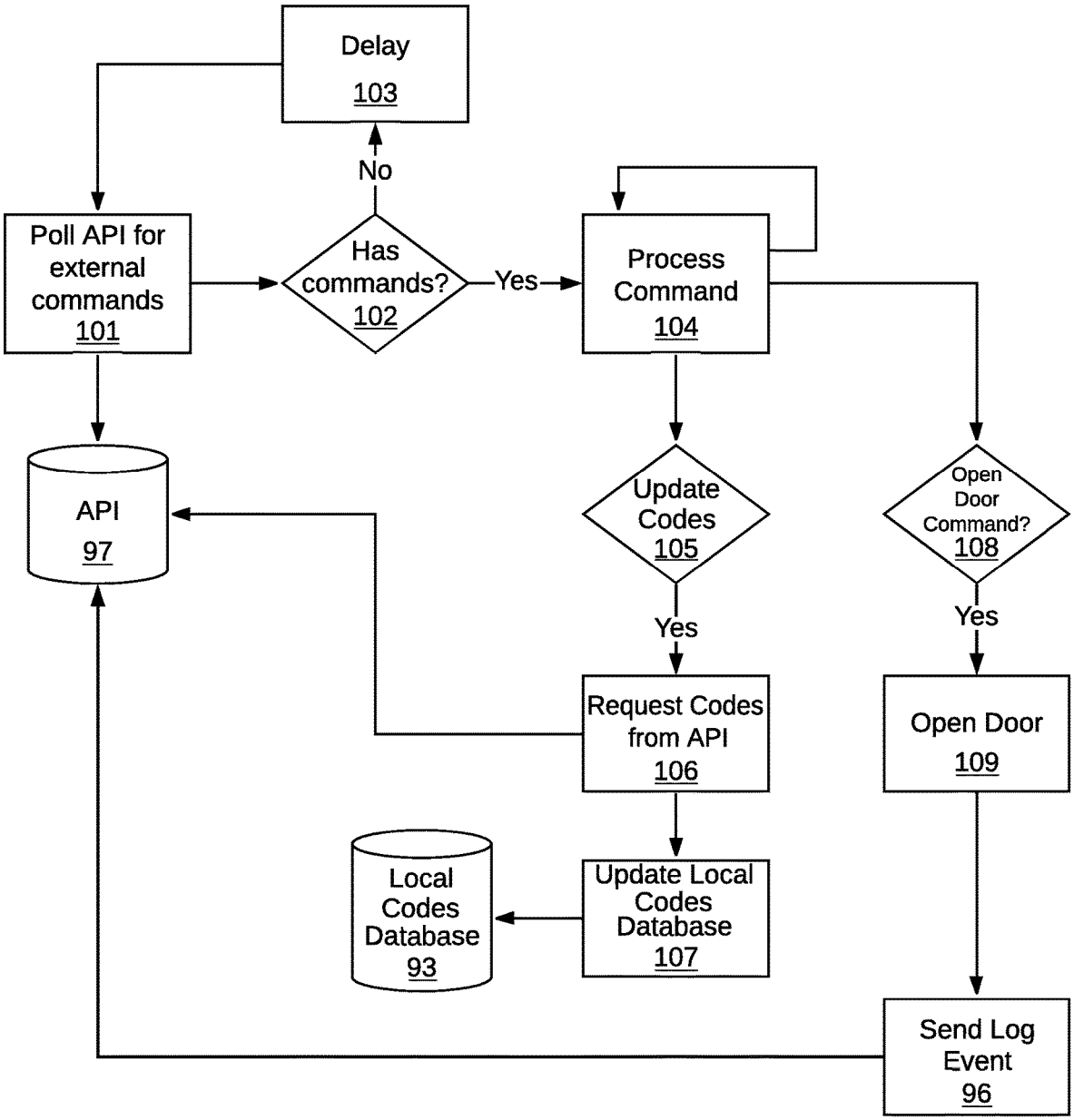
FIG. 12 is a flow diagram illustrating example communications between a device of the furniture unit and a separate device via an API.

FIG. 12 is a process flow diagram of example communications between the controller [81] and an external device via an API [97]. For instance, by polling [101] the API for external commands and processing [104] any available commands, controller [81] can update [107] its local codes database [93], or it can open [95] the appropriate door lock.

The disclosed embedded package vault can have alternate uses, variations, or modifications that are within the scope of the disclosure. For example, the package vault may be only inside a hall closet rather than in a full furniture unit. Embodiments also include integration into custom closet configurations. The structure housing the embedded package vault may have or use different finish options. The furniture unit may have different entry options such as an exterior camera for barcode scanning, the ability to type in the last few digits of tracking numbers to access from the exterior, the ability to type in personal codes to access from the exterior (e.g., similar to sharing a gate code with a delivery person to deliver a package), and the exterior door may have a sensor that is triggered by an activator on a package, drone, or delivery person. In some embodiments, a drawer in the furniture unit can slide out automatically to the exterior to allow for drone delivery. In some embodiments, a drawer in the furniture unit may slide out into the interior of the home for easy access.

In some embodiments, the furniture unit has cooling and warming capabilities. Controller [81] may be operatively coupled to a temperature control unit, enabling temperature control or for temperature to be maintained in a desired range for a set number of hours. The app can notify the homeowner that a package from a retailer has arrived and will ask them if they would like the delivered package cooled or warmed. Over time, the furniture unit can utilize machine learning to prompt homeowners based on knowledge of past choices, e.g. for all deliveries from the meal kit delivery service the embedded package vault will ask the homeowner if they would like it chilled.

In some embodiments, customers will have the option of using the furniture unit for package pickup. The customers can input relevant information into the app. This will signal to the delivery service that there is a pickup at the specified address. The delivery service can notify the customer when the pickup is scheduled, and the homeowner can put the package to be returned into the furniture unit on the specified day and input that it is ready to be picked up in the app. This will trigger LED lights on the exterior keypad to illuminate, which signals to the delivery person that there is a package inside that's ready for pickup.

The invention claimed is:

1. A package receipt furniture unit for installation in a building, comprising:

an exterior piece and an interior piece securable together through a wall of the building, the interior piece having a bottom wall securable to a sill of the building, wherein the exterior piece comprises an exterior door providing access to an interior compartment whose bottom wall is the bottom wall of the interior piece, wherein the exterior door comprises trim proximal to an exterior wall finish, and the exterior piece further comprises an exterior keypad, and wherein the interior piece comprises the interior compartment with bottom wall securable to the sill of the building, the interior compartment protruding into the building from a base of an upper wall of the interior piece flush with an interior wall of the building, and the interior compartment having an interior door; and an electronic control unit operably coupled to a local code database, an interior door lock mechanism on the interior door, an exterior door lock mechanism on the exterior door, the exterior keypad, and an interior keypad, and wherein the electronic control unit is operable to validate an access code from the exterior or the interior keypad against the local code database, and to operate the exterior door lock mechanism or the interior door lock mechanism, respectively, if the access code is validated.

2. The package receipt furniture unit of claim 1 wherein the exterior piece further comprises a mail slot, and the upper wall of the interior piece further comprises a mail catch connected to the mail slot by a mail chute, wherein the mail catch is located below the mail slot so as to receive mail dropped into the mail slot.

3. The package receipt furniture unit of claim 2 wherein the mail slot is located on the exterior keypad.

4. The package receipt furniture unit of claim 1 wherein the exterior door is comprised of a face frame having at least two connectors extending orthogonally from said face frame for insertion into at least two receivers contiguous with the interior compartment of the interior piece, and wherein the trim of the exterior door is securable to the face frame by an adjustment bolt for accommodating any exterior wall finish.

5. The package receipt furniture unit of claim 4 wherein the exterior piece further comprises a mail slot, and the upper wall of the interior piece further comprises a mail catch connected to the mail slot by a mail chute, wherein the mail catch is located below the mail slot so as to receive mail dropped into the mail slot.

6. The package receipt furniture unit of claim 5 wherein the mail slot is located on the exterior keypad.

7. The package receipt furniture unit of claim 1 wherein the interior piece forms a hall tree, and the interior compartment forms a bench of the hall tree.

* * * * *